US012807395B2

(12) United States Patent
Mustafa

(10) Patent No.: US 12,807,395 B2
(45) Date of Patent: Nov. 24, 2026

(54) PACK

(71) Applicant: British American Tobacco (Investments) Limited, London (GB)

(72) Inventor: Isaak Mustafa, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 522 days.

(21) Appl. No.: 16/609,112

(22) PCT Filed: Apr. 26, 2018

(86) PCT No.: PCT/GB2018/051101
§ 371 (c)(1),
(2) Date: Oct. 28, 2019

(87) PCT Pub. No.: WO2018/197880
PCT Pub. Date: Nov. 1, 2018

(65) Prior Publication Data

US 2020/0198877 A1 Jun. 25, 2020

(30) Foreign Application Priority Data

Apr. 28, 2017 (GB) ..... 1706847

(51) Int. Cl.
*B65D 85/10* (2006.01)
*B65D 75/58* (2006.01)

(52) U.S. Cl.
CPC ..... *B65D 85/1045* (2013.01); *B65D 75/5838* (2013.01)

(58) Field of Classification Search
CPC ... B65D 85/10; B65D 85/12; B65D 85/10568
See application file for complete search history.

(56) References Cited

U.S. PATENT DOCUMENTS 5,819,924 A * 10/1998 Sigrist ..... B65D 85/1027 229/231
10,968,034 B2 * 4/2021 Rodrigues ..... B65D 85/1036
(Continued)

FOREIGN PATENT DOCUMENTS

EP 1813553 A1 8/2007
EP 3037365 A1 6/2016
(Continued)

OTHER PUBLICATIONS

European Examination Report for corresponding application 18 722 710.3; Report dated Feb. 8, 2022.
(Continued)

*Primary Examiner* — Ernesto A Grano
*Assistant Examiner* — Symren K Sanghera
(74) *Attorney, Agent, or Firm* — CANTOR COLBURN LLP

(57) ABSTRACT

A wrapped bundle comprising tobacco industry products wrapped in a barrier material is disclosed. The barrier material comprises an extraction region in the barrier material and the bundle comprises a label that is attached to the barrier material to cover the extraction region. The label has a peripheral portion that extends beyond the extraction region and is peelable in use away from the barrier material to open the extraction region to provide access to the tobacco industry products. The barrier material comprises paper having a paper weight greater than 85 gsm.

13 Claims, 5 Drawing Sheets

(56) References Cited

U.S. PATENT DOCUMENTS

| | | | | |
|---|---|---|---|---|
| 2004/0009732 | A1* | 1/2004 | Nowak | D04H 1/732 156/60 |
| 2007/0196611 | A1* | 8/2007 | Chen | E04F 13/16 52/311.1 |
| 2010/0163563 | A1* | 7/2010 | Lutzig | B65D 85/1027 220/495.01 |
| 2011/0302886 | A1* | 12/2011 | Ghini | B65B 19/223 53/232 |
| 2012/0174534 | A1* | 7/2012 | Cavazza | B65B 51/10 53/228 |
| 2012/0211380 | A1* | 8/2012 | Ghini | B65B 19/226 206/245 |
| 2014/0110286 | A1* | 4/2014 | Bertuzzi | B65D 75/5894 206/268 |
| 2017/0021994 | A1* | 1/2017 | Sebastian | D21H 19/82 |
| 2019/0225410 | A1* | 7/2019 | Häfker | B65B 19/28 |
| 2019/0270577 | A1* | 9/2019 | Cailleaux | B65B 5/024 |
| 2020/0039733 | A1* | 2/2020 | Rodrigues | B65D 5/662 |
| 2020/0115145 | A1* | 4/2020 | Soriano | B65D 85/10484 |
| 2020/0247605 | A1* | 8/2020 | Polloni | B65D 85/1027 |
| 2020/0290794 | A1* | 9/2020 | Collins | B65D 85/10568 |
| 2022/0002948 | A1* | 1/2022 | Ribu | B32B 1/00 |

FOREIGN PATENT DOCUMENTS

| | | | |
|---|---|---|---|
| JP | 2004204366 | A | 7/2004 |
| RU | 2443613 | C2 | 2/2012 |
| WO | 9822368 | A1 | 5/1998 |
| WO | 9928212 | A1 | 6/1999 |
| WO | 2013120913 | A1 | 8/2013 |
| WO | 2013120916 | A1 | 8/2013 |
| WO | 2015087079 | A1 | 6/2015 |
| WO | 2016059366 | A1 | 4/2016 |
| WO | 2016087819 | A1 | 6/2016 |
| WO | 2017042332 | A1 | 3/2017 |
| WO | 2018197880 | A1 | 11/2018 |

OTHER PUBLICATIONS

International Search Report for corresponding application PCT/GB2018/051101 filed Apr. 26, 2018; Mail date Jun. 12, 2018.

Written Opinion of the International Searching Authority for corresponding application PCT/GB2018/051101 filed Apr. 26, 2018; Mail date Jun. 12, 2018.

* cited by examiner

PACK

TECHNICAL FIELD

The present invention relates to a pack containing tobacco industry products and to a wrapped bundle of tobacco industry products.

BACKGROUND

Tobacco industry products, such as cigarettes, are sold in packs. Known packs often comprise an outer carton made from cardboard which has a base and a hinged lid. The base contains a bundle of smoking articles. The smoking articles are wrapped in a flexible barrier layer made of metallized plastic or of a plastic/metal foil laminate. The barrier layer comprises an extraction opening to facilitate removal of a smoking article from the pack by a consumer when the lid is open. The opening is closed by a flexible cover which extends over the extraction opening and which may be peeled back by a consumer once the lid has been pivoted into an open position to reveal the extraction opening. A peripheral region of the cover may be coated with a non-permanent re-stick adhesive where it overlaps the barrier layer around the edge of the opening so that the cover can be peeled back and replaced a number of times to re-seal the pack and maintain freshness of the smoking articles remaining in the pack.

To ensure efficient re-adhesion of the label, an inner frame is provided within the bundle so that it extends partially around the cigarettes beneath the barrier layer. The inner frame provides a reaction surface within the bundle against the resealing pressure exerted by the label around the periphery of the extraction opening.

SUMMARY

According to the invention there is provided, a wrapped bundle comprising tobacco industry products wrapped in a barrier material, the barrier material comprising an extraction region in the barrier material, the bundle comprising a label that is attached to said barrier material to cover the extraction region, wherein the label has a peripheral portion that extends beyond the extraction region and is peelable in use away from the barrier material to open the extraction region to provide access to the tobacco industry products, wherein the barrier material comprises paper having a paper weight greater than 85 gsm.

The label may form a separate covering adhered to the surface of the barrier material.

The bundle may be free of an inner frame between the tobacco industry products and the barrier material.

The barrier material may comprise overlapping regions, wherein the bundle is free of any adhesive between the overlapping regions.

The wrapped bundle may form a parallelepiped having a front face and a rear face separated by side faces, wherein at least one of the overlapping regions of the barrier material lie substantially along one of the side faces of the wrapped bundle.

The overlapping regions may be unsealed.

The peripheral portion of the label may be adhered to the barrier material by re-stick adhesive.

The label may be attached to the lid so that in use the peripheral portion of the label is peeled away from the barrier material at the same time the lid is rotated into the open position.

The barrier material may be coated.

The paper may have a paper weight greater than 100 gsm.

The paper may have a paper weight greater than 150 gsm.

The paper may have a paper weight greater than 160 gsm.

The paper may have a paper weight less than 180 gsm.

The paper may have a paper weight less than 200 gsm.

The paper may have a paper weight less than 220 gsm.

Also according to the invention there is provided a pack comprising a base; a lid mounted to the base for rotation between open and closed positions; and the wrapped bundle of tobacco industry products received in the base.

Also according to the invention there is provided a reel of barrier material comprising a plurality of blanks for use in forming the wrapped bundle of tobacco industry products.

Each of the plurality of blanks may comprise predetermined fold lines.

Each of the plurality of blanks may comprise a line of weakness that defines the extraction region of the wrapped bundle.

Also according to the invention there is provided a method of forming the wrapped bundle, the method comprising wrapping the tobacco industry products in the barrier material.

BRIEF DESCRIPTION OF THE DRAWINGS

Embodiments of the invention will now be described, by way of example only, with reference to the accompanying drawings, in which.

DETAILED DESCRIPTION

Figure 1:
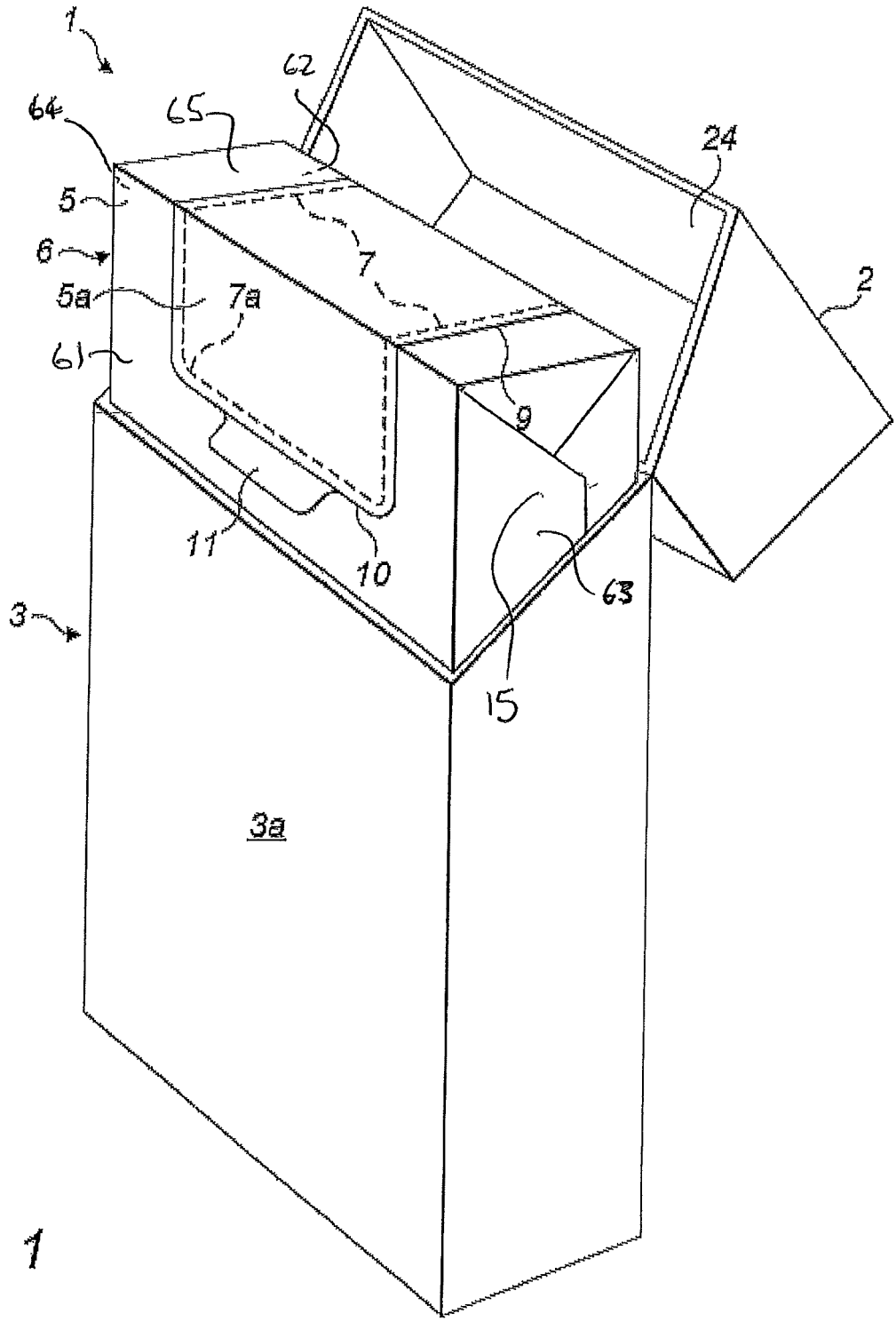
FIG. 1 shows a pack containing tobacco industry product according to an embodiment of the invention.

Embodiments of the invention provide a wrapped bundle 6 comprising tobacco industry products wrapped in a barrier material 5, herein referred to as a barrier layer 5. The barrier layer 5 comprises an extraction region such as an opening 8 in the barrier layer 5. The bundle comprises a label 9 that is attached to said barrier layer 5 to cover the extraction opening 8, wherein the label 9 has a peripheral portion that extends beyond the extraction opening 8 and is peelable in use away from the barrier layer 5 to open the extraction opening 8 to provide access to the tobacco industry products. The barrier layer 5 comprises paper having a paper weight greater than 85 gsm.

The wrapped bundle 6 may alternatively have a paper weight greater than 100 gsm, greater than 150 gsm, or greater than 160 gsm. Preferably, the wrapped bundle has a paper weight less than 180 gsm, less than 200 gsm or less than 220 gsm. Even more preferably, the wrapped bundle has a paper weight of 170 gsm.

Providing a paper barrier layer 5 in any of the recited paper weight ranges offers advantages both in the structure and manufacturability of the pack which are explained below.

Preferably the paper material used for the barrier layer 5 may be coated in a moisture resistant finish which better protects the cigarettes 4 retained therein, for example a polymer resin. Alternatively, the paper material used for the barrier material 5 may be a trans metalized paper laminate.

As used herein, the term "tobacco industry product" is to be understood as including smoking articles comprising combustible smoking articles such as cigarettes, cigarillos, cigars, tobacco for pipes or for roll-your-own cigarettes, (whether based on tobacco, tobacco derivatives, expanded tobacco, reconstituted tobacco, tobacco substitutes or other smokable material), electronic smoking articles such as e-cigarettes, heating devices that release compounds from substrate materials without burning such as tobacco heating products; and hybrid systems to generate aerosol from a combination of substrate materials, for example hybrid systems containing a liquid or gel or solid substrate.

In one embodiment, the tobacco industry product is a smoking article for combustion selected from the group consisting of a cigarette, a cigarillo and a cigar.

In one embodiment, the tobacco industry product is a non-combustible smoking article.

In one embodiment the tobacco industry product is a heating device which releases compounds by heating, but not burning, a substrate material. The material may be for example tobacco or other non-tobacco products, which may or may not contain nicotine. In one embodiment the heating device is a tobacco heating device.

In another embodiment the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment the hybrid system comprises a liquid or gel substrate and tobacco.

In one embodiment, a rigid card outer pack 1 may also be provided as shown in FIG. 1. The outer pack 1 comprises a hinged lid 2 and a base 3 containing the wrapped bundle 6 which protrudes from an open end of the base 3.

In the embodiments described below, the wrapped bundle 6 comprises a charge of cigarettes and takes the form of a parallelepiped. For example, a charge of 20 cigarettes formed from 3 rows of cigarettes, the front and back rows being 7 cigarettes wide and the middle row being only 6 cigarettes wide, so as to allow the cigarettes to lie in a close packed arrangement. The parallelepiped bundle 6 has front face and rear faces 61, 62, each face 61, 62 defined as a plane lying across the front and rear rows of cigarettes respectively. The bundle 6 also has side faces 63, 64 which separate front and rear faces 61, 62 and a top face 65 and a bottom face (not shown). The top face lies 65 coincident with the upper ends—normally the filter ends—of the charge of cigarettes and the bottom face lies coincident with the bottom ends of the cigarettes.

Edges 7 of the extraction opening 8 are indicated by dotted lines extending from the rear face 62 of the bundle 6 across the top face 65 of the bundle 6 and down the front face 61 as far as a lower front wall extraction opening edge 7*a*.

A label 9 overlies the extraction opening 8 and section 5*a*. The label 9 is a layer of material having on its undersurface facing the barrier layer 5, and section 5*a*, a re-stick adhesive. Alternatively, a permanent bonding adhesive may be applied to the portion of the undersurface of the label 9 that overlaps section 5*a* but does not extend beyond it. Where the label 9 extends beyond the edges 7 of the extraction opening 8, the undersurface of the label 9 is provided with a coating of re-stick adhesive.

The label 9 has a lower front wall edge 10 and includes a tab 11 extending from the lower front wall edge 10 which is at least partly free of re-stick adhesive so that it may be flicked up by the user and used to peel back the label 9 in order to open the extraction opening 8.

On first opening, the edge 7 of the extraction opening 8 separating section 5*a* from the remainder of the barrier layer 4 may be defined by lines of weakening in the barrier layer 5 or by actual cuts (shown by dotted lines in FIG. 1). When the label 9 is pulled back, the section 5*a* of the barrier layer 5, which remains adhered to the underside of the label 9, separates from the remainder of the barrier layer 5 along the lines of weakening or cuts to open the extraction opening 8. The consumer is then free to remove cigarettes 4 from the bundle 6 through the extraction opening 8 and, after having done so, reseal or close the extraction opening 8 by bringing down the tab 11 so that the edge of the label 9 re-adheres to the barrier layer 5 in a region surrounding the periphery of the extraction opening 8. The section 5*a* of barrier layer 5 formed by the separation when the tab 11 is lifted is returned to its previous position within the extraction opening 8. Although there is a line of separation in the barrier layer 5, it is covered by the adhered edges of the label 9.

It shall be appreciated that the label 9 needs not be separate covering adhered to the surface of the barrier layer 5, but may instead be integral with the barrier layer 5. For example, the paper barrier layer 5 may be formed from a paper laminate material having an inner layer and an outer layer, where the combined layers of the paper laminate have a paper weight greater than 85 gsm, or in the above recited ranges. The inner layer is defined as the layer adjacent the cigarettes. In such embodiments, the outer edges of the label 9 are cut into the outer layer of the paper laminate by a laser or other suitable means, while the bounds 7 of the extraction opening 8 are cut into the inner layer.

By using a barrier layer 5 having a paper weight greater than 85 gsm or in the above recited ranges, the periphery of the extraction opening 8 is strengthened and provides a reaction surface against the resealing pressure as the edge of the label 9 is re-adhered to the barrier layer 5. Conventional barrier layers do not provide sufficient support against this resealing pressure and require an inner frame as described above which increases the complexity of assembling the wrapped bundle. Therefore an advantage of the present invention is that the inner frame can be omitted. This removes a step of the pack assembly process in which an inner frame is folded around a bundle of cigarettes. By removing the inner frame the cost of the pack is reduced both as a result of the simplified assembly process and through reduced material use.

Figure 2:
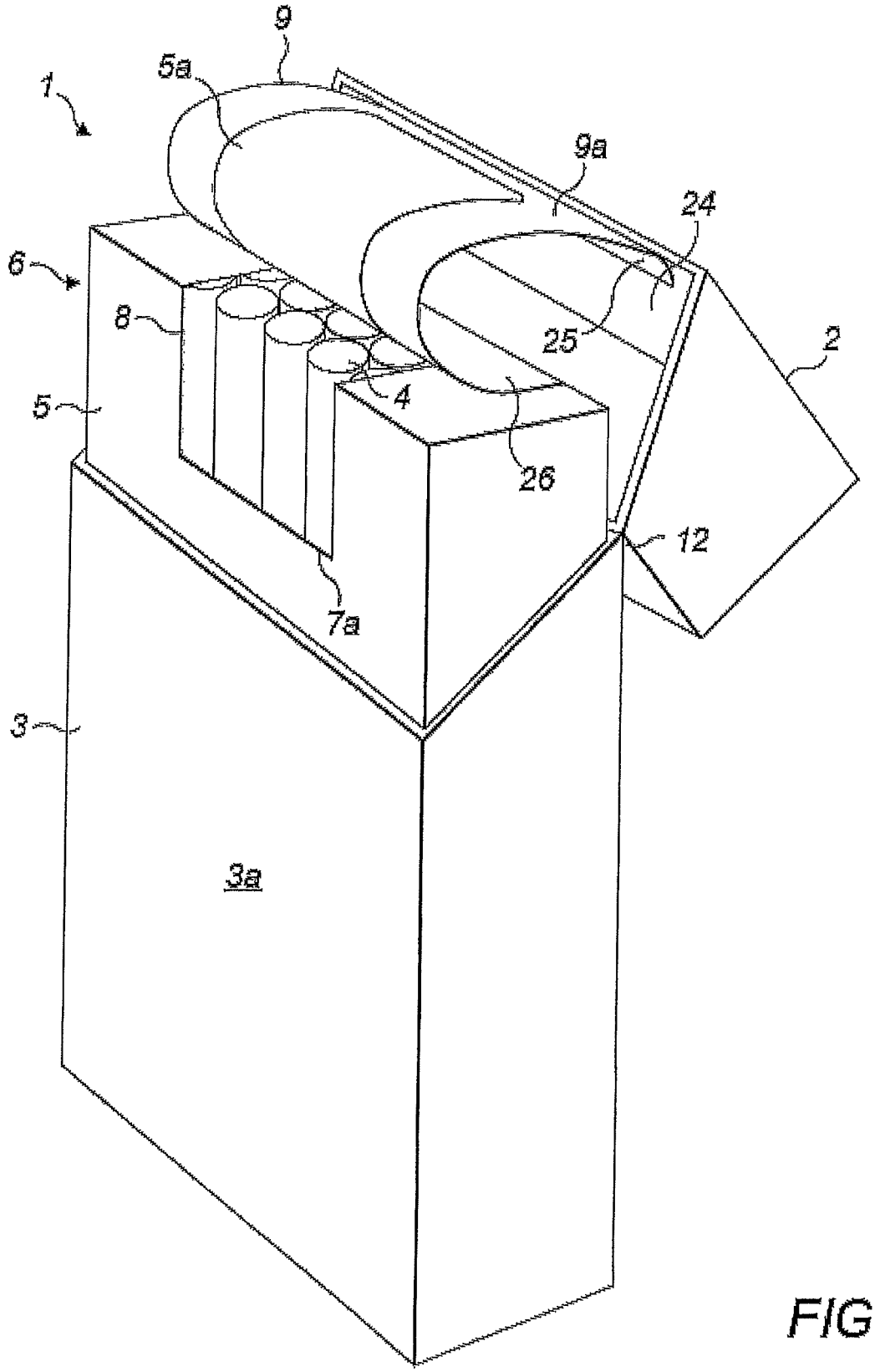
FIG. 2 shows a pack containing tobacco industry product with a lid of the pack in an open position, according to an embodiment of the invention.

As the tab 11 can be relatively difficult to grasp, where an outer pack 1 is provided, the label 9 and/or tab 11 may be attached to the inside surface 24 of the front wall of the lid 2 so that the label 9 is peeled back to reveal the extraction opening 8 at the same time the lid 2 is opened. In particular, with the lid 2 in an open position, as shown in FIG. 2, section 5*a* of the barrier layer 5 is drawn back to reveal the extraction opening 8 and enable a consumer to readily extract a cigarette 4 from the bundle 6.

To achieve simultaneous opening of the lid 2 and label 9, the label 9 has a region adjacent to its lowermost edge that is designated as a tab 25. The tab 25 is folded back on itself about a fold-line 26 that separates the tab 25 from the remainder of the label 9 so that a surface 27 of the tab 25 lies against or faces an outer surface of the label 9 when the lid 2 is closed. The opposite face 29 of the tab 25, which faces outwardly, is attached to an inner surface 24 of the lid 2 using a permanent adhesive. It will also be appreciated that the outer surface 29 of the tab 25 can be permanently adhered to the inner surface 24 of the lid 2 without folding it back prior to gluing. In this arrangement, the tab 25 will be folded back relative to the remainder of the label 9 only when the lid 2 is in an open position.

When the lid 2 is pivoted about hinge 12 into its open position, the label 9 is also pulled due to the connection between the tab 25 and the lid 2. This results in the label 9 being peeled back or rolled away from the extraction opening 8 with the section 5*a* of the barrier layer 5 also being lifted away from the extraction opening 8 together with the label 9. If the pack 1 is being opened for the first time, then region 5*a* will also separate from the remainder of the barrier layer 5 along the line of weakening that separates region 5*a* from the remainder of the barrier layer 5, as the lid 2 is opened. As the lid 2 opens, the tab 25 pivots relative to the remainder of the label 9 about the fold-line 26.

It will be appreciated that, when the lid 2 is rotated about the hinge 12 back into its closed position, the label 9 will roll back across the extraction opening 8 and the region of the barrier layer 5*a* will re-position itself within the extraction opening 8. The peelable adhesive coating the peripheral region of the label 9 will also re-adhere to the barrier layer 5 surrounding the extraction opening 8, thereby closing the pack 1.

Figure 3:
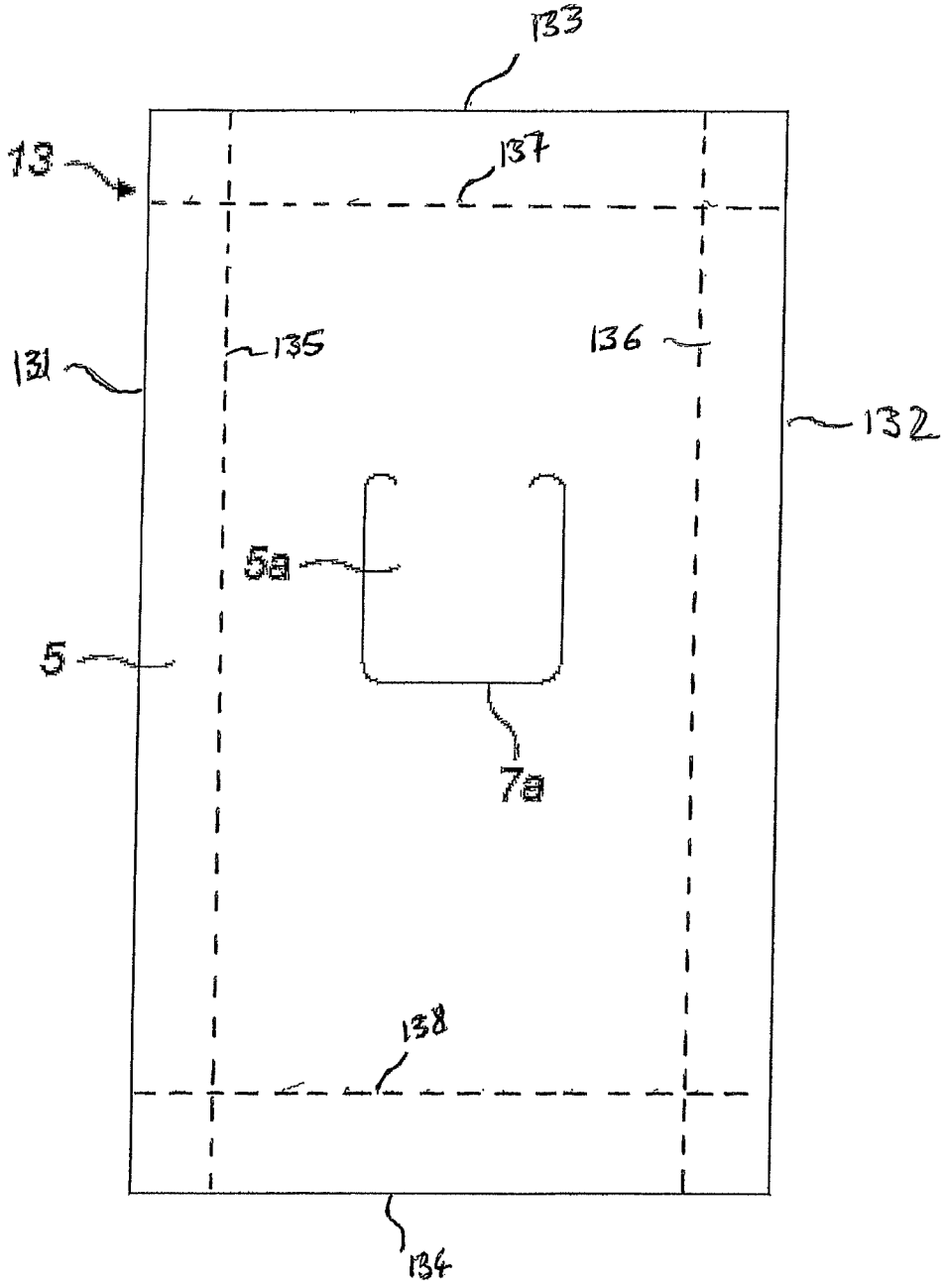
FIG. 3 shows a blank of barrier layer material for forming a wrapped bundle according to embodiments of the invention.

A blank 13 of barrier layer material 5 for wrapping around the cigarettes 4, prior to forming the bundle 6, is shown in FIG. 3. The blank 13 is rectangular with the removable section 5*a* disposed substantially in the centre. The removable section 5*a* is orientated so that its lower edge 7*a* extends transversely across the blank 13. The blank comprises longitudinal edges 131, 132—defined as the relatively longer edges of the blank 13—and transverse edges 133, 134—defined as the relatively shorter edges of the blank 13. The longitudinal edges are arranged parallel to longitudinal axes of the cigarettes when the blank is folded thereabout.

Optionally pre-determined fold lines are provided in the blank shown in dashed form in FIG. 3. The fold lines may be pre-embossed into the blank 13 prior to the blank 13 being wrapped about a charge of cigarettes. The fold lines weaken the blank to remove the blank's shape memory and encourage the folded edges of the blank 13 to remain flush with sides of the bundle 6. Two sets of fold lines may be provided, transverse fold lines 137, 138 that extend parallel to transverse edges 133, 134 of the blank 13, and longitudinal fold lines 135, 136 that extend parallel to the longitudinal edges 131, 132 of the blank 13.

Figure 5:
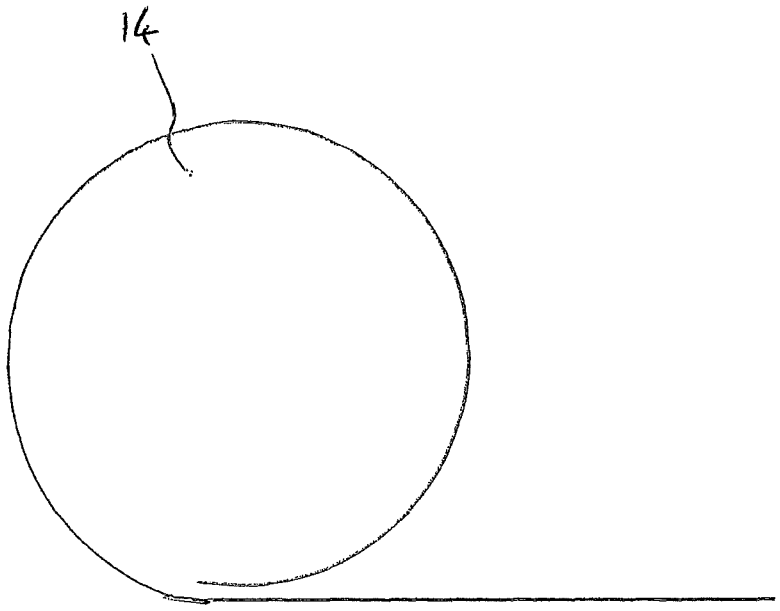
FIG. 5 shows a reel of barrier material.

A plurality of blanks may be provided on a reel 14 and fed into a cigarette assembly process as described below. Such a reel is shown schematically in FIG. 5.

Figure 4:
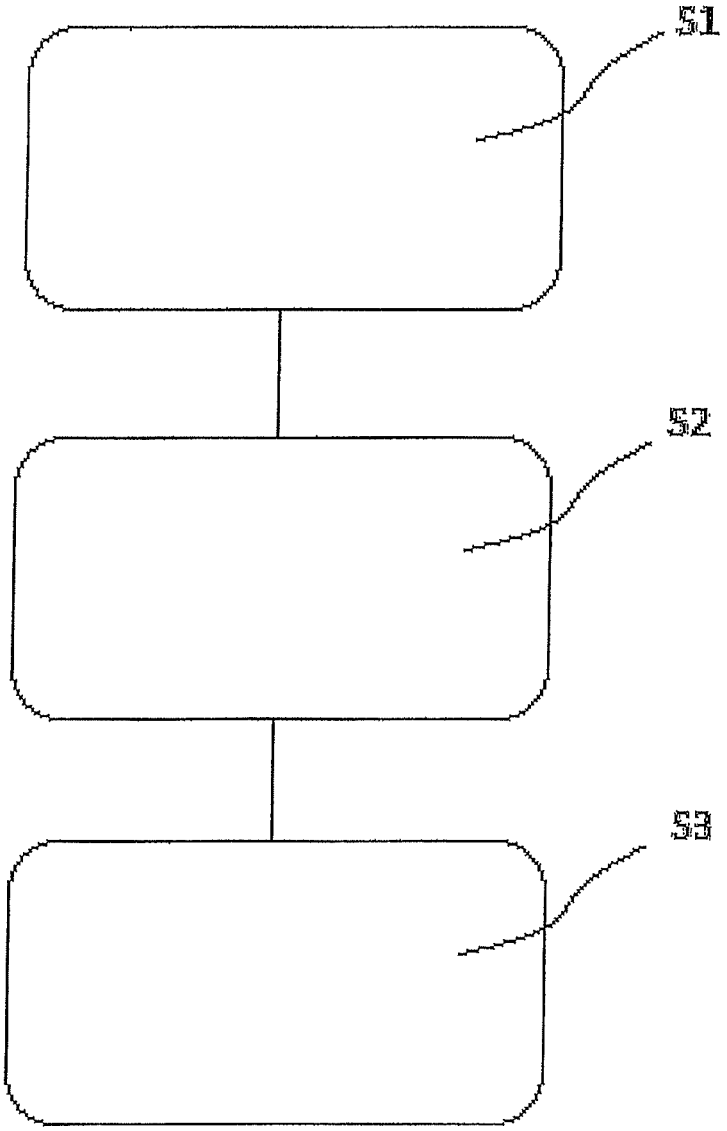
FIG. 4 shows the assembly steps of an assembly process for the wrapped bundle.

During an assembly process of the bundle 6, shown in FIG. 4, the blank 13 of barrier layer material 5 is wrapped directly about a charge of cigarettes 4 so that the barrier layer 5 is directly adjacent the cigarettes 4. It shall be understood that the term 'directly adjacent' is intended to mean that no other structure or material is provided between the cigarettes 5 and the barrier layer 5, such as an inner frame.

In a first assembly step S1, a charge of cigarettes 4 is collated together in which the cigarettes 4 are arranged side by side and in tightly spaced rows. Arranged in this way, the charge of cigarettes 4 substantially takes the form of a parallelepiped. For example, a charge of 20 cigarettes formed from 3 rows of cigarettes, the front and back rows being 7 cigarettes wide and the middle row being only 6 cigarettes wide so as to allow the cigarettes to lie in a close packed arrangement. The parallelepiped charge 4 has front face and rear faces, each face defined as a plane lying across the front and rear rows of cigarettes respectively. The parallelepiped charge 4 also has side faces which separate front and rear faces and a top face and a bottom face. The top face lies coincident with the upper ends—normally the filter ends—of the charge of cigarettes and the bottom face lies coincident with the bottom ends of the cigarettes.

In a second step S2, the blank 13 is separated from the reel 14 and folded in on itself around the parallelepiped charge of cigarettes 4. The removable section 5*a* of the blank 13 is disposed adjacent the top face of the charge of cigarettes 4 so that, when the wrapped bundle 6 is fully formed, the cigarettes may be removed from the bundle 6 filter end first.

In a third step S3, peripheral regions of the blank 13 that extend beyond the charge of cigarettes 4 are folded down to form sides of the bundle 6. The peripheral regions overlap when folded so as to completely enclose the cigarettes 4 and form overlapping regions 15, see FIG. 1 for example. Preferably the longitudinal edges 131, 132 of the blank 13 are folded down along longitudinal fold lines 135, 136 onto the side faces of the parallelepiped charge of cigarettes, while the transverse edges 133, 134 are folded down along transverse fold lines 137, 138 onto the bottom face of the charge. However, as an alternative the transverse edges may instead be folded down onto the rear face of the charge of cigarettes.

Known packs, in which the barrier layer is made of metallized plastic or of a plastic/metal foil laminate require overlapping peripheral regions to be sealed so that they are held flush with sides of the bundle and do not foul an outer pack when the bundle and the outer pack are combined.

An advantage of forming the bundle from a blank 13 of paper barrier layer material 5 having a paper weight greater than 85 gsm or in the above recited ranges is that the folds are sufficiently stiff to hold the overlapping peripheral regions flush with the sides of the bundle 6. This further reduces the unit cost of a pack 1 by eliminating the requirement to include apparatus for sealing the bundle 6.

It shall be appreciated that the paper weights referred to herein and denoted as gsm refer to grams per square meter, sometimes referred to as grammage, and are recited in accordance with the ISO 536 standard for the determination of paper and board weight.

In order to address various issues and advance the art, the entirety of this disclosure shows by way of illustration embodiments in which the claimed invention(s) may be practiced and provide a superior pack for smoking articles. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A pack comprising a base;

a lid mounted to the base for rotation between open and closed positions; and a wrapped bundle received in the base, the wrapped bundle comprising tobacco industry products wrapped in a barrier material comprising paper having a paper weight greater than 85 gsm, the barrier material comprising an extraction region in the barrier material, the bundle comprising a label that is adhered to said barrier material to cover the extraction region, wherein the label has a peripheral portion that extends beyond the extraction region and is adhered to the barrier material by re-stick adhesive so that, in use, the label is peelable in use away from the barrier material to open the extraction region to provide access to the tobacco industry products, said re-stick adhesive also enabling the peripheral portion of the label to re-adhere to the barrier material when the label is returned to its original position, wherein the barrier material is folded so that it comprises overlapping regions, each overlapping region being completely unsealed and free of any adhesive therebetween, said overlapping regions being retained in position, during repeated opening of the extraction region by peeling of the label, by the stiffness of the paper barrier material and confinement of the wrapped bundle within the base, wherein the wrapped bundle forms a parallelepiped having a front face and a rear face separated by side faces, wherein the overlapping regions lie substantially along the side faces of the wrapped bundle, and wherein the barrier material is directly adjacent to the tobacco industry products such that no other structure or material is provided between the tobacco industry products and the barrier layer.

2. A pack according to claim 1, wherein the label forms a separate covering adhered to the surface of the barrier material.

3. A pack according to claim 1, wherein the label is attached to the lid so that in use the peripheral portion of the label is peeled away from the barrier material at the same time the lid is rotated into the open position.

4. A pack according to claim 1, wherein the paper has a paper weight greater than 100 gsm.

5. A pack according to claim 1, wherein the paper has a paper weight greater than 150 gsm.

6. A pack according to claim 1, wherein the paper has a paper weight greater than 160 gsm.

7. A pack according to claim 1, wherein the paper has a paper weight less than 180 gsm.

8. A pack according to claim 1, wherein the paper has a paper weight less than 200 gsm.

9. A pack according to claim 1, wherein the paper has a paper weight less than 220 gsm.

10. A reel of barrier material comprising a plurality of blanks for use in forming the pack of tobacco industry products of claim 1.

11. A reel of barrier material according to claim 10, wherein each of the plurality of blanks comprises predetermined fold lines.

12. A reel of barrier material according to claim 10, wherein each of the plurality of blanks comprises a line of weakness that defines the extraction region of the wrapped bundle.

13. A method of forming the pack of claim 1, the method comprising wrapping the tobacco industry products in the barrier material.

* * * * *